US006578364B2

(12) United States Patent
Corey

(10) Patent No.: US 6,578,364 B2
(45) Date of Patent: Jun. 17, 2003

(54) MECHANICAL RESONATOR AND METHOD FOR THERMOACOUSTIC SYSTEMS

(75) Inventor: John A. Corey, Melrose, NY (US)

(73) Assignee: Clever Fellows Innovation Consortium, Inc., Troy, NY (US)

( * ) Notice: Subject to any disclaimer, the term of this patent is extended or adjusted under 35 U.S.C. 154(b) by 0 days.

(21) Appl. No.: 10/126,594

(22) Filed: Apr. 19, 2002

(65) Prior Publication Data

US 2002/0166325 A1 Nov. 14, 2002

Related U.S. Application Data

(60) Provisional application No. 60/285,139, filed on Apr. 20, 2001.

(51) Int. Cl.[7] ..... F25B 9/00
(52) U.S. Cl. ..... 62/6
(58) Field of Search ..... 62/6

(56) References Cited

U.S. PATENT DOCUMENTS

| | | | | |
|---|---|---|---|---|
| 4,114,380 A | | 9/1978 | Ceperly | |
| 4,355,517 A | | 10/1982 | Ceperly | |
| 4,398,398 A | | 8/1983 | Wheatley et al. | |
| 4,489,553 A | | 12/1984 | Wheatley et al. | |
| 4,858,441 A | | 8/1989 | Wheatley et al. | |
| 4,953,366 A | | 9/1990 | Swift et al. | |
| 5,139,242 A | | 8/1992 | Yarr | |
| 5,146,123 A | | 9/1992 | Yarr | |
| 5,303,555 A | | 4/1994 | Chrysler et al. | |
| 5,389,844 A | | 2/1995 | Yarr et al. | |
| 5,813,234 A | * | 9/1998 | Wighard | 62/6 |
| 5,996,345 A | | 12/1999 | Hofler | |
| 6,353,987 B1 | | 3/2002 | Corey | |

FOREIGN PATENT DOCUMENTS

| | | |
|---|---|---|
| WO | WO 99/20957 | 4/1999 |

OTHER PUBLICATIONS

Grant, L., "An Investigation of the Physical Characteristics of a Mass Element Resonator," Naval Postgraduate School, Monterey, California, Mar. 1992.

* cited by examiner

*Primary Examiner*—William C. Doerrler
*Assistant Examiner*—Malik N. Drake
(74) *Attorney, Agent, or Firm*—Hoffman, Warnick & D'Alessandro LLC; Spencer K. Warnick

(57) ABSTRACT

A mechanical resonator for a thermoacoustic device having a compressible fluid contained within a housing, the housing having a pair of heat exchangers and a thermodynamic medium therebetween. The resonator includes a member for mimicking dynamic conditions at a position of the housing; and a linear suspension element suspending the member in the housing. The mechanical resonator saves length and eliminates high-velocity flow losses. A transducer may also be mounted with the mechanical resonator to derive power in another form from the system, for example, electricity, or introduce power into the system. In combination, the transducer and mechanical resonator allow for cool-side driving of a thermoacoustic system.

26 Claims, 7 Drawing Sheets

TRAVELLING WAVE PHASING VS TIME, AT '*'

MECHANICAL RESONATOR AND METHOD FOR THERMOACOUSTIC SYSTEMS

This application claims priority to U.S. provisional patent application No. 60/285,139, filed Apr. 20, 2001, under 35 U.S.C. §119(e).

BACKGROUND OF THE INVENTION

1. Technical Field

The present invention relates generally to thermoacoustic systems, and more particularly, to a mechanical resonator and method for thermoacoustic systems.

2. Related Art

Thermoacoustic systems may serve many purposes in modem society including energy conversion. For instance, thermoacoustic engines convert thermal power to mechanical power. These can be combined with generators that convert mechanical power to electrical. Thermoacoustic systems driven by motors convert electrical, pneumatic or hydraulic power to mechanical and then to thermal output (cooling or heating). All of these devices depend on machinery to accomplish the conversion, and all have limits in cost, efficiency, and size, which make one type or another well or ill suited to particular applications.

Thermoacoustic devices such as those described in U.S. Pat. Nos. 4,114,380 and 4,355,517 to Ceperly and 4,398,398 and 4,489,553 to Wheatley, provide rugged, simple and low-cost conversion of heat energy to mechanical energy in the form of oscillating acoustic pressure and volume in a contained gas, or vice versa. These devices can provide engines or heat pump/coolers. The primary components of these devices are an elongate housing containing a compressible fluid, a warmer heat exchanger in thermal communication with an external reservoir near the warmer temperature, a cooler heat exchanger in thermal communication with a reservoir at or near that cooler temperature, and a thermodynamic medium in the form of either the fluid itself or an element such as a 'stack' or regenerator between the heat exchangers. The principles of operation of stacks are explained more fully in U.S. Pat. No. 4,489,553, which is hereby incorporated by reference. A device using a regenerator instead of a stack and including an additional fluid path (having acoustic inertance, capacitance, resistance or a combination thereof) creates a Stirling-like cycle in the compressible fluid particles near the regenerator. See, for instance, U.S. Pat. No. 4,355,517 to Ceperly. The above-described devices are commonly identified as 'standing wave' and 'travelling wave' types, respectively. The operation of these devices requires a resonant compressible fluid (gas) circuit to define and sustain the oscillations in the compressible fluid.

Unfortunately, creation of this resonant circuit requires a long, enclosed structure or housing, akin to an organ pipe, in which the fluid is contained. The length of the housing and the physical properties of the compressible fluid determine the operating frequency. For commonly-preferred gases (e.g., air, helium), the resulting length is too great for many uses.

A masters thesis by Larry A. Grant, entitled "Investigation of the Physical Characteristics of a Mass Element Resonator," dated 1992 (NTIA ADA2521792, originally from the Naval Postgraduate School at Monterrey, Calif.) discloses a bellows (having mass and stiffness) in lieu of a central part of a thermoacoustic resonator to "reduce those acoustic losses that are a parasitic load on the cold end of the refrigerator, as well as make the resonator more compact."

While Grant introduces the concept of mechanical equivalence, the bellows structure disclosed has been found unworkable for everyday thermoacoustic devices. In particular, Grant's studies related to a system that operates at a very high frequency similar to a piezo-electric system, while many thermodynamic devices suitable for general applications (e.g., those driven by 60 Hz grid electricity) operate at lower frequencies similar to a loudspeaker system. For these lower frequencies, practical systems require higher stroke and pressure amplitude than can be reliably sustained by a bellows as Grant disclosed. Uncontrolled secondary motions arise in the bellows and the material of the bellows succumbs to fatigue. Accordingly, Grant's system does not translate to common thermoacoustic devices. No other structure was suggested by Grant.

A PCT application to DeBlok, WO 99/20957, discloses a traveling wave thermoacoustic system having a membrane or bellows construction that provides a mass-spring-system. Unfortunately, a membrane or bellows construction has been found unstable and, therefore, is inadequate to provide meaningful shortening of the gas resonator length.

In view of the foregoing, there is a need in the art for a device to shorten the length of housings in thermoacoustic devices so broader applications can be attained. It would also be advantageous if the device incorporated mechanisms for attaining energy conversion such as a transducer.

SUMMARY OF THE INVENTION

A first aspect of the invention is directed to a mechanical resonator for a thermoacoustic device having a compressible fluid contained within a housing having a pair of heat exchangers and a thermodynamic medium therebetween, the resonator comprising: a member for mimicking dynamic conditions at a position of the housing; and a linear suspension element suspending the member in the housing.

A second aspect of the invention is directed to a thermoacoustic system comprising: a housing enclosing a compressible fluid capable of supporting an acoustical wave; a first heat exchanger; a second heat exchanger; a thermodynamic medium interposed between the heat exchangers for sustaining a temperature gradient in the compressible fluid between the heat exchangers; and a mechanical resonator mounted in the housing adjacent the heat exchangers, the mechanical resonator including: a member mounted for reciprocation along a direction of fluid oscillation and to form a substantial barrier to passage of the compressible fluid, and a linear suspension element for suspending the member during reciprocation, the suspension element coupled to the housing.

A third aspect of the invention is directed to a method for shortening a thermoacoustic device having a housing for containing a compressible fluid and thermodynamically active components therein that operate at a known frequency and a known temperature, the method comprising the steps of: determining dynamic conditions at a position within the housing; and replacing at least a portion of the fluid and housing adjacent the position by suspending a mechanical resonator having a member that matches the dynamic conditions at the position within the housing.

A fourth aspect of the invention is directed to a thermoacoustic system comprising: a) a housing enclosing a compressible fluid capable of supporting an acoustical wave; b) a standing wave thermoacoustic subsystem including: a first heat exchanger, a second heat exchanger, wherein the second heat exchanger is cooler than the first heat exchanger, and a thermodynamic medium interposed between the heat exchangers for sustaining a temperature gradient in the compressible fluid between the heat exchangers; c) a mechanical resonator mounted for reciprocation along a direction of fluid oscillation and to form a substantial barrier to passage of the compressible fluid; and d) a transducer coupled to the mechanical resonator.

A fifth aspect of the invention is directed to a mechanical resonator for a thermoacoustic device having a compressible fluid contained within a housing, the housing having a pair of heat exchangers and a thermodynamic medium therebetween, the resonator comprising: a member adjacent a cooler one of the heat exchangers; and a thermal insulation on the member.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

DESCRIPTION OF THE PREFERRED EMBODIMENTS

For purposes of ease of description only, the following subtitles have been provided:

I. Thermoacoustic Overview

II. Mechanical Resonator

III. Cold Side Driving

I. Thermoacoustic Overview

In a fundamental thermoacoustic machine, pressure and displacement waves occur within an extended containment of gas in combination with a temperature gradient along the direction of oscillating displacement. If the thermal gradient is above a critical value (depending on details of construction and gradient position), then power is added to the waves, reinforcing the acoustic energy stored therein. If the gradient is less than a critical value, then work must be added to sustain the oscillations and heat is pumped against the gradient. Many configurations are possible, but the two most common are called "standing wave" and "travelling wave" types, of which FIGS. 1 and 2 are representative examples, respectively.

Figure 1:
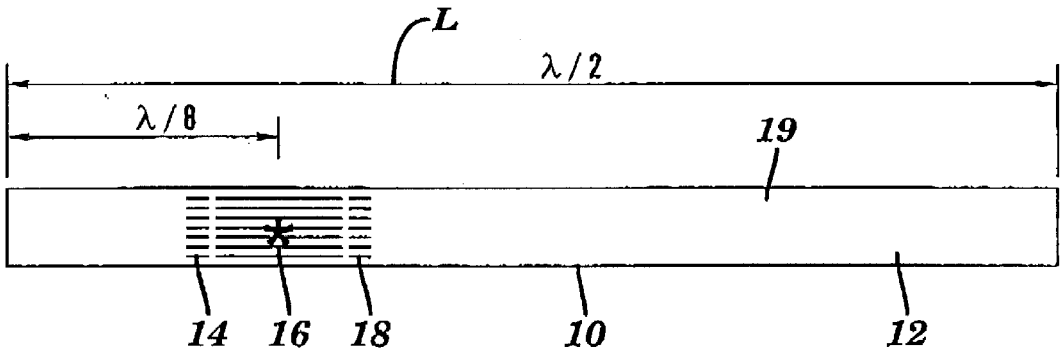
FIG. 1 PRIOR ART
FIG. 1 shows a prior art standing wave type thermoacoustic device.
Figure 3:
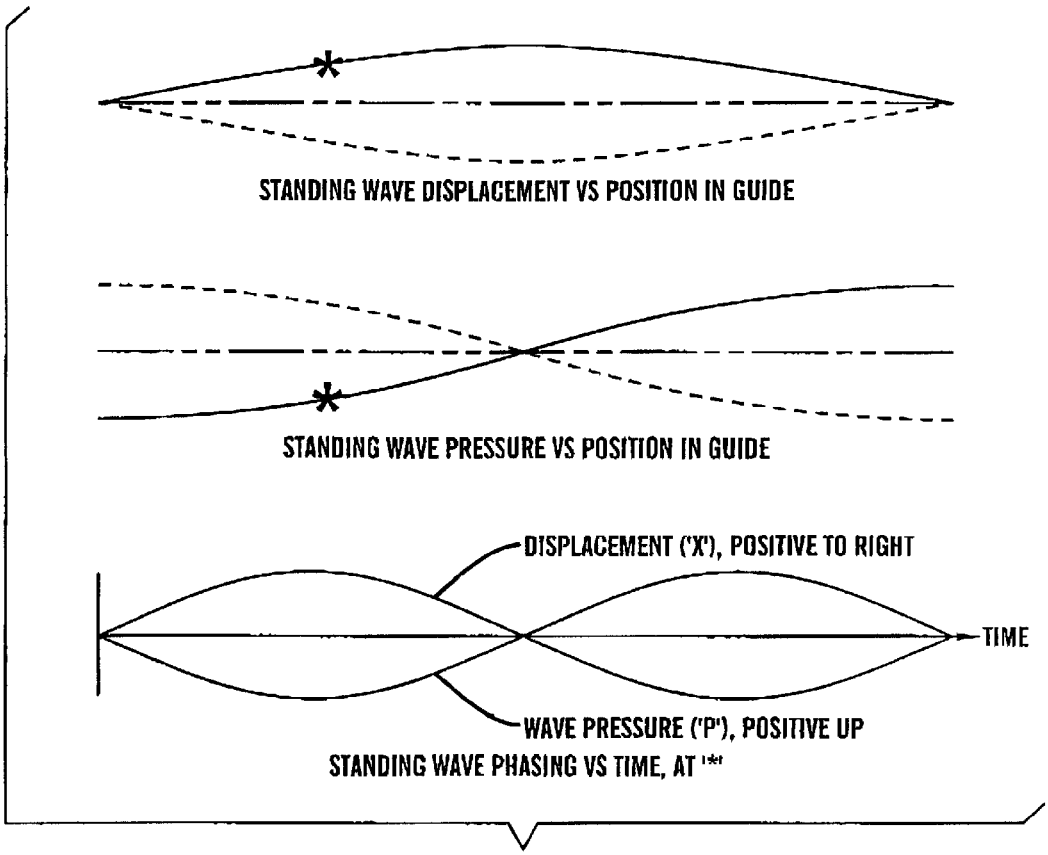
FIG. 3 PRIOR ART
FIG. 3 shows pressure and velocity conditions along the device of FIG. 1.

FIG. 1 shows a housing or waveguide containment 10 of length L, filled with a compressible fluid 12 (e.g., a gas such as helium) of sound speed a, such that a standing wave of wavelength $\lambda=2L$ and frequency $f=a/(2L)$ can be sustained therein. FIG. 3 shows the pressure and velocity conditions in the standing wave. Shown at approximately $\lambda/8$ (FIG. 1) are a warmer heat exchanger 14, a thermodynamic medium 16, e.g., a stack, and a cooler heat exchanger 18. The rest of housing 10 acts as a resonator. Thermodynamic medium 16 is capable of sustaining a temperature gradient in compressible fluid 12 between heat exchangers 14, 18. In one embodiment, thermodynamic medium 16 is configured as an array of surface elements with high heat capacity, spaced apart in the gas flow at a distance such that during the higher velocity portion of the oscillations of gas therein, little thermal relaxation occurs between the gas and surfaces. In contrast, in the lower-velocity portions of the oscillation (i.e., toward the extremes of the gas displacement oscillation), the gas thermally relaxes toward the local surface temperatures by exchanging heat with its adjacent surfaces. The surface spacings, as taught by U.S. Pat. No. 4,489,553 to Swift et al., are about four thermal penetration depths, where the thermal penetration is a function of frequency, thermal diffusivity, density, and specific heat of the gas.

In operation, the system of FIG. 1 experiences the pressure and displacement oscillations shown in FIG. 3, which cause particles of gas in the region of thermodynamic medium 16 to experience temperature oscillations caused with the pressure oscillations and substantially in phase with the displacement oscillations. In this way, the pressure-induced gas temperature swings have extremes associated with the displacement extremes. If the local surface temperature at these extreme positions is different from the gas temperature, then heat exchange occurs during the effective residence time there. When the surface temperature gradient is less than the pressure-induced temperature gradient, then the gas rejects heat to the surface at the warmer end of its motion and accepts heat at the cooler end, functioning as a heat pump or refrigerator. In this case, work must be supplied to the gas from an external source to sustain operation, e.g., via a drive transducer. If the surface temperature gradient is greater than the pressure-induced gas temperature gradient, then the gas accepts heat at the warmer position and rejects heat at the cooler position, functioning as an engine. In this case, work flows into the gas from the thermal source, reinforcing and sustaining the acoustic energy.

Figure 2:
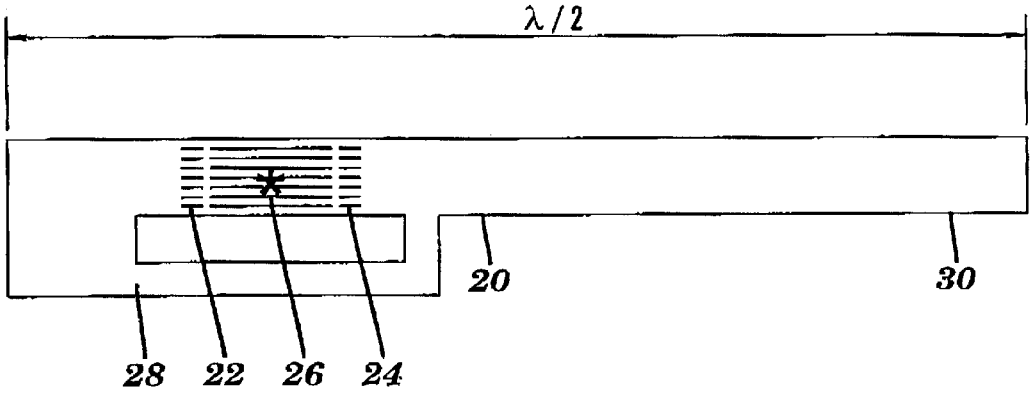
FIG. 2 PRIOR ART
FIG. 2 shows a prior art traveling wave type thermoacoustic device.
Figure 4:
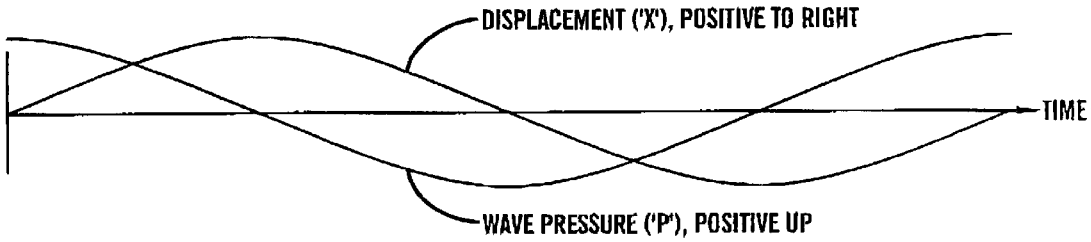
FIG. 4 PRIOR ART
FIG. 4 shows pressure and velocity condition along the device of FIG. 2.

FIG. 2 shows a comparable-length housing or waveguide 20 in which the thermally active regions have another configuration, i.e., of a traveling wave system. Warmer and cooler heat exchangers are still present, but are identified as acceptor 22 and rejector 24. They are separated by a thermodynamic medium 26 in the form of a regenerator instead of a stack. In addition, a second fluid passage or bypass 28 connects the two sides of the heat exchanger-regenerator combination in parallel with the passage through these components. Second passage 28 provides fluidic resistance, but also inertance and compliance, the acoustic equivalents of mass and inverse-stiffness in a mechanical dynamic system. The added degree of freedom provided by passage 28 causes the pressure and displacement waves reaching the two end faces of the heat exchanger-regenerator combination to be locally out of time phase by nearly 90 degrees (pressure and velocity are nearly in phase), rather than pressure and displacement being nearly in phase as in the case of the standing wave machine of FIG. 1. This "traveling" wave phasing (see FIG. 4) is substantially thermodynamically equivalent to a Stirling cycle for those gas particles in the vicinity of heat exchangers 22, 24 and regenerator 26. Note, however, the primary standing wave phasing dominates through most of the length of the resonator, far from the heat exchangers and second passage. With travelling wave phasing, heat flows toward rejector 24 and resonator end 30 of housing 20 regardless of the temperature gradient. If acceptor 22 is warmer than rejector 24, the device operates as an engine (prime mover). If acceptor 22 is cooler than rejector 24, the device operates as a heat pump or refrigerator.

Both the standing wave and travelling wave type devices of FIGS. 1 and 2 have long compressible fluid resonators, compared to the characteristic lengths of heat exchangers/regenerator and thermodynamic medium.

Figure 5A:
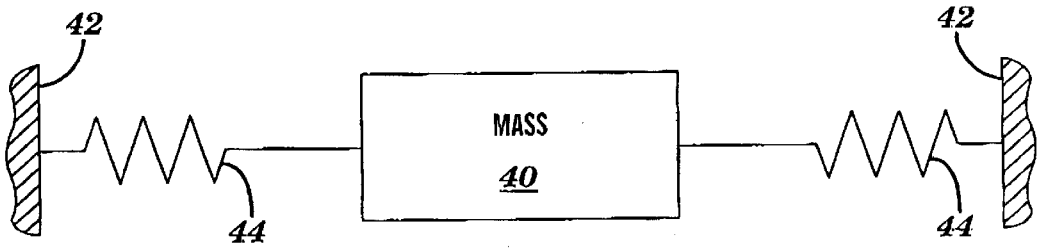
FIG. 5A shows a lumped mechanical system representation of the device of FIG. 1.

Referring to FIG. 5A, the standing wave type machine of FIG. 1 is shown in lumped equivalent, demonstrating that the dynamics of a continuous column of compressible fluid like that in FIG. 1 can be approximated by lumped model consisting of a mass 40 connected to ground 42 by two springs 44. The mass represents the central third (approximately) of the housing, a place where, as shown by reference to FIG. 3, fluid 12 moves with relatively high velocity, but undergoes relatively little pressure swings. In this way, that parcel of fluid 12 may be represented as a moving slug of matter, the compressibility being relatively unimportant there, where little compression or expansion occurs, but movement is significant. Conversely, the parcels of fluid 12 in the outer thirds of the housing see relatively little motion (and none at all at their extreme ends), while experiencing high-amplitude swings in pressure. In this way, these parcels act much like springs, undergoing cyclic compression and expansion, but moving little. Put another way, the energy storage of the central parcel is predominately in kinetic form, proportional to the product of mass and the velocity squared. In contrast, the energy storage of the outer parcels is predominately in potential form, proportional to the product of fluid constant (stiffness) and the volume change (by displacement of the central parcel) squared. The sum of these two energies is constant when the system is in resonance.

Figure 5B:
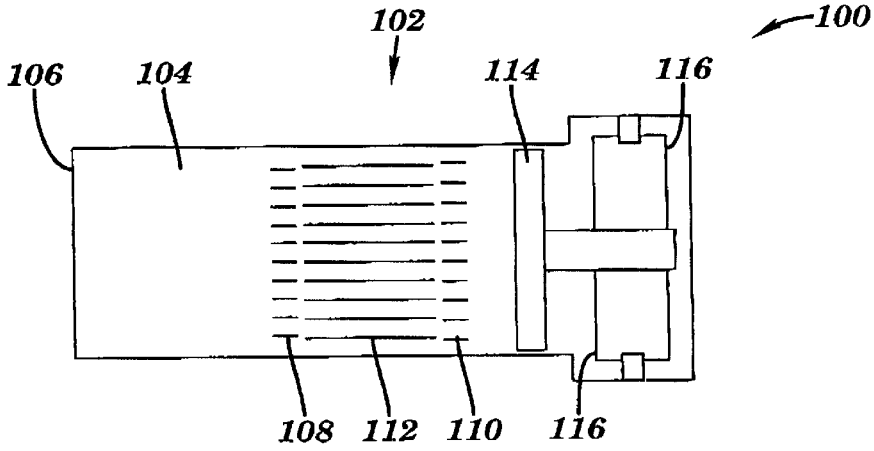
FIG. 5B shows a suspended mechanical resonator in accordance with the present invention.

When considering a first spring-like gas parcel of FIG. 1 that contains heat exchangers 14, 18, and when looking towards the other parcels which largely comprise a gas resonator 19, the gas resonator appears dynamically equivalent to a mass and spring, as modelled by the lumped system of FIG. 5A. FIG. 5B shows a system where gas resonator 19 is replaced with such an actual mass and spring. The mass and spring replacement is chosen as to make the total system, including the stiffness of the first parcel, resonate at the same frequency as the continuous gas column in gas resonator 19. Indeed, since the original column is continuous, the resonator can be viewed at any point and have some ratio of mass and stiffness found that is exactly equivalent, dynamically, to the part of the resonator from that point on. It should be understood that mass and stiffness equivalents are not constant as we consider points along the original length, but that there is a range of values associated with different positions. Further, although illustrated using the simpler arrangement of FIG. 1, this same equivalence applies for devices of the type shown in FIG. 2, and indeed for any device where there exists a compressible fluid with periodic oscillations in pressure and displacement along a common axis.

II. Mechanical Resonator

Figure 7:
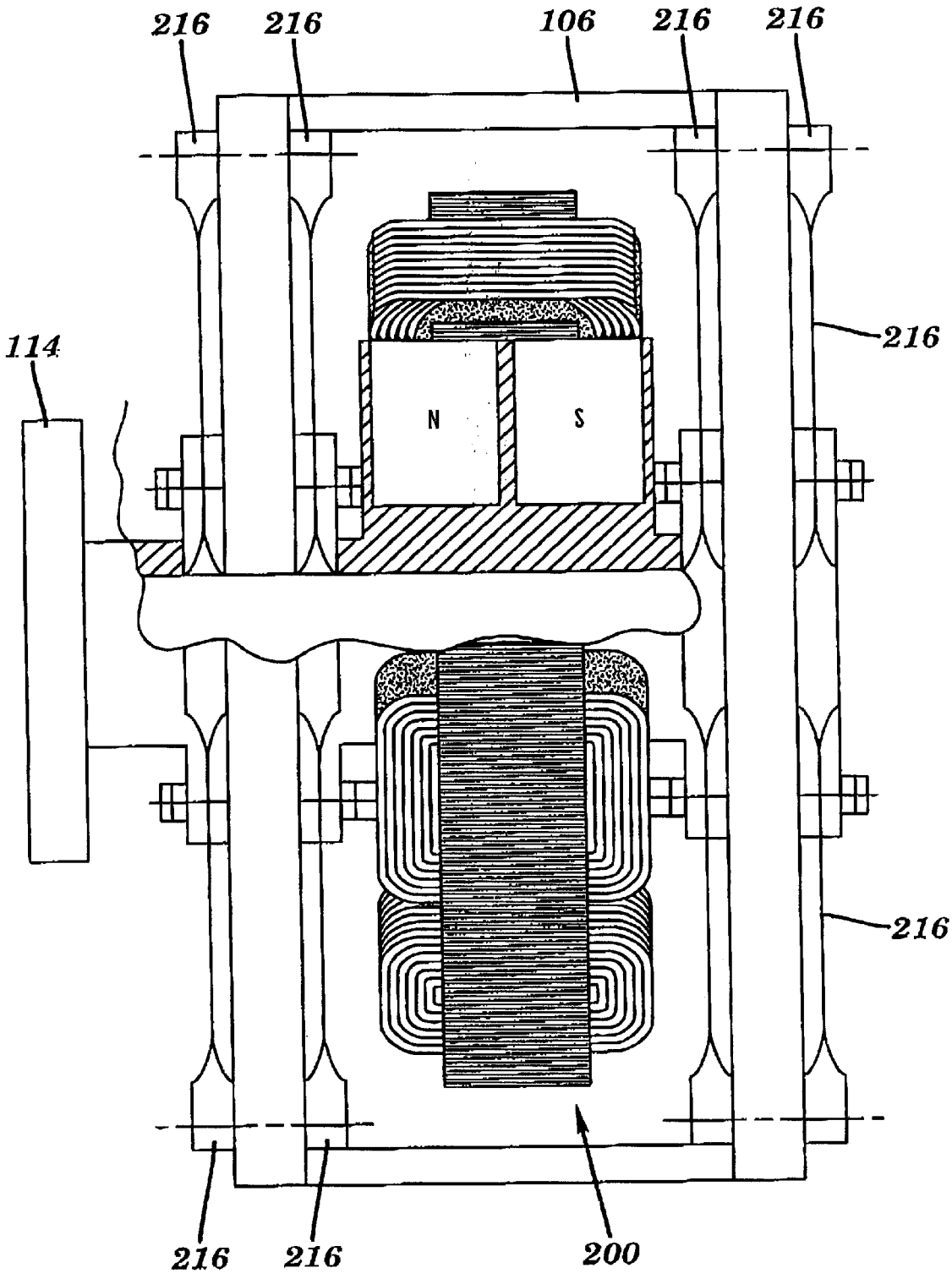
FIG. 7 shows a suspended mechanical resonator with a transducer.

With continuing reference to FIG. 5B, a mechanical resonator 100 is shown for a thermoacoustic device 102 having a compressible fluid 104 contained within a housing 106 having a pair of heat exchangers 108, 110 and a thermodynamic medium 112 therebetween. Compressible fluid 104 is capable of supporting an acoustical wave. Mechanical resonator 100 includes a member 114 for mimicking dynamic conditions at a position of housing 106, and a linear suspension element(s) 116 suspending member 114 in housing 106. Dynamic conditions may include, inter alia: a complex velocity and a pressure of compressible fluid 104. Member 114 is mounted for reciprocation along a direction of fluid oscillation and forms a substantial barrier to passage of compressible fluid 104. Suspension element(s) 116 may be any now known or later developed element(s) for linearly directing member 114. In one embodiment, suspension element(s) 116 are like those in co-pending U.S. patent application Ser. No. 09/591,480. That is, suspension element (s) 116 may include a number of legs to prevent fretting and wear. Each leg has a first portion 117 for coupling to member 114, and a second portion 119 coupled to housing 106 by any now known or later developed method, e.g., by a mount 121. Alternatively, as shown in FIG. 7, suspension elements may be provided in other forms. Suspension elements 216, shown in FIG. 7, are like those described in U.S. Pat. No. 5,139,242. Both the above-mentioned patent and application are hereby incorporated by reference.

Mechanical resonator 100 provides a solid-state mass, i.e., member, and spring system that replaces all or part of the compressible fluid resonator (removed part of housing 106) used in thermoacoustic devices, saving length and eliminating high-velocity flow losses. Mechanical resonator 100 is tuned to substantially replicate the dynamic conditions of the gas resonator at a position within the housing. The provision of linear suspension element(s) 116 provides, inter alia, stability and predictability to movement of member 114. Mechanical resonator 100 allows for a compact energy conversion system with the ruggedness and simplicity of thermoacoustics, plus greater power density and efficiency and a wider choice of input/output power forms. It should be recognized that some resistance, also called friction or drag, is inevitable with a mechanical resonator, as it is also in a compressible-fluid resonator (with the viscous drag between moving gas and containment wall). However, a well designed mechanical resonator 100 will exhibit sub-critical drag, enabling oscillations to occur.

Figure 6A:
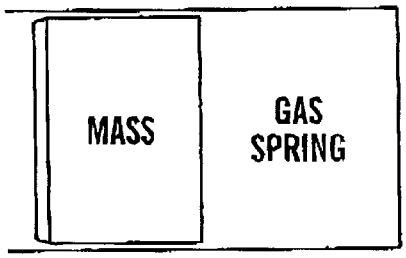
FIGS. 6A–D show various forms of mechanical resonator members.
Figure 6B:
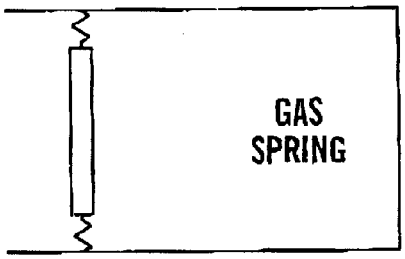
Figure 6C:
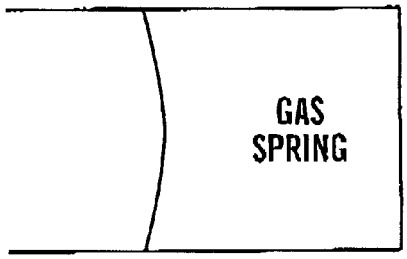
Figure 6D:
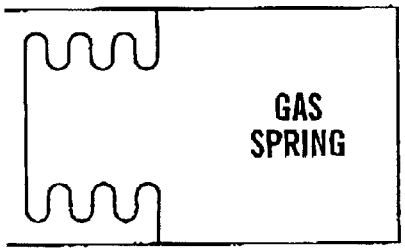

FIGS. 6A–D show various forms of mechanical resonator members that may be used in accordance with the invention. FIGS. 6A–B do not include the suspension elements for clarity. The suspension elements would be provided, for example, within the housing where the gas spring is shown. The simplest type of equivalent mechanical resonator, shown in FIG. 6A, comprises a solid-state mass or piston fitted to the housing or gas containment and substantially blocking flow of gas across its seal. An enclosed volume behind the piston may serve as an additional spring, i.e., a gas spring, to that of suspension element(s) 116. FIG. 6B shows a solid-state mass suspended by a flexible seal to form a gas spring. FIG. 6C shows a diaphragm to form a gas spring. FIG. 6D shows a bellows to form a gas spring (akin to Grant).

In one embodiment, the above mechanical resonator 100 has been found advantageous with a standing wave thermoacoustic subsystem. In this setting, a standing wave thermoacoustic subsystem includes, as shown in FIG. 5B, a first heat exchanger 108, a second heat exchanger 110, and a thermodynamic medium 112 interposed between the heat exchangers for sustaining a temperature gradient in compressible fluid 104 between the heat exchangers. No passage 28, as shown in FIG. 2, is provided in a standing wave thermoacoustic device. Mechanical resonator 100 can also be located toward a distal end of a less shortened housing 106 and used mainly to force a desired operating frequency and prevent higher harmonics in the fluid column.

Some exemplary numbers on the size of the reduction in length provided by a mechanical resonator according to the invention are instructive. A half-wavelength gas resonator operating at 60 cycles per second (60 Hz) and using helium with a sound speed of about 1000 feet per minute must be about 16 feet long (1000/(60)). A preferred location for the heat exchangers and thermodynamic medium is about the ⅛ wavelength point (for compromise between efficiency and power density), or about 4 feet from one end. A mechanical resonator can be less than a foot long (piston and gas spring), making the entire assembly less than 5 feet long instead of 16. Even greater savings are possible for designs where the heat exchangers and thermodynamic medium are closer to the end of the gas resonator (for higher efficiency by virtue of lower velocity and associated viscous loss, at the expense of lower power density by virtue of lower mass flow in the heat exchangers). Such higher efficiency arrangements are susceptible to unintended higher mode operation (at double or triple frequency), which is prevented by the fixed resonant frequency derived from the mass and stiffness of the mechanical resonator.

III. Cool-Side Driving

In conventional electrically-transduced thermoacoustic devices, chiefly associated with electric-drive refrigeration in standing-wave systems, the drive transducer (often called the "driver") has always been placed at or near a velocity node (and pressure antinode) of the housing/waveguide. For a basic ½-wavelength containment, this means the driver is on the warmer side of the refrigerator if near a heat exchanger at all (alternate positioning being near the far end of the ½-wavelength housing). This is thermally beneficial because any waste heat from the driver (presumed less than 100% efficient) is close to the warmer, rejection heat exchanger, and does not load the cool side reducing the net refrigeration available there. Unfortunately, this separation, whether near the warm heat exchanger or at the far end of the housing, requires a long gas resonator to complete the system.

Figure 8:
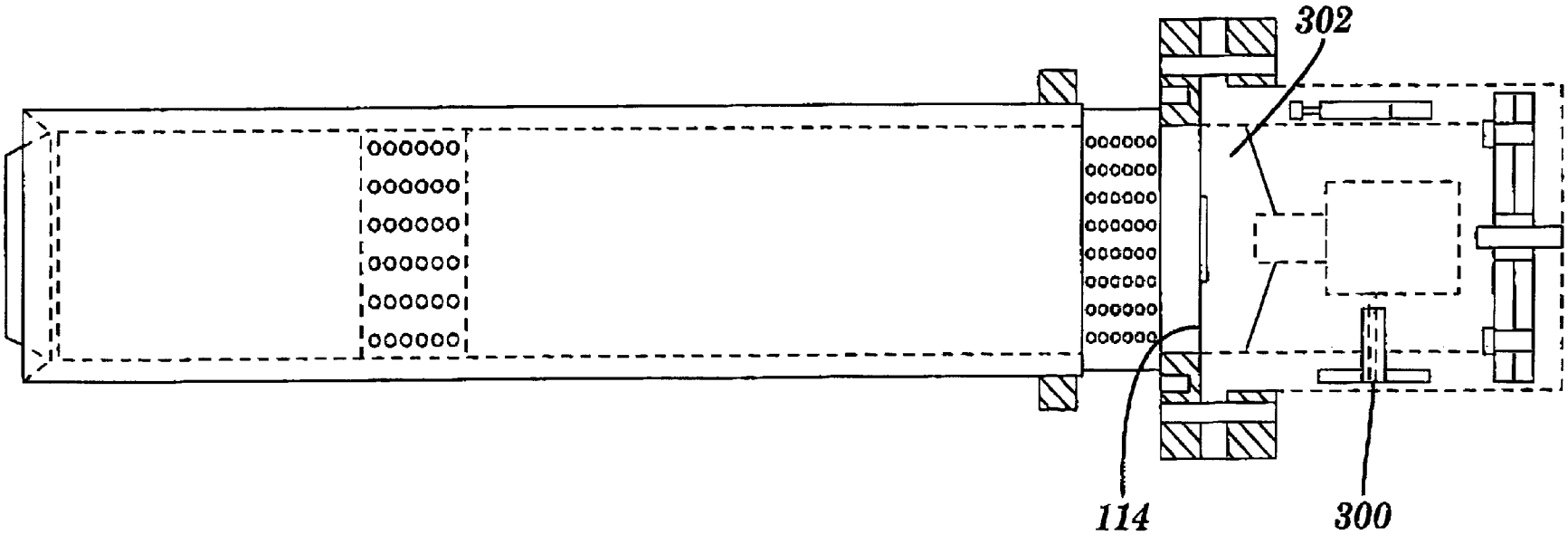
FIG. 8 shows a thermoacoustic device engine-generator incorporating a mechanical resonator in accordance with the present invention.

If the driver, in cooperation with the mechanical resonator described above, is placed instead adjacent to the cooler heat exchanger, the mechanical resonator can be "tuned" to replace most of the long resonator and to provide its dynamic equivalent, at least from the perspective of the dynamic effects on the thermally-active fluid in the heat exchangers and thermodynamic medium. FIG. 7 shows a transducer 200, i.e., a driver, coupled directly to a mechanical resonator member 114. FIG. 8 also shows a transducer 300 coupled to a mechanical resonator 114. The placement of mechanical resonator 114 adjacent a cooler heat exchanger has not been possible with previously known drivers, such as ordinary loudspeakers, because they cannot be configured to provide the combination of high efficiency, high power density, and high swept volume and force, required to efficiently couple (i.e., through a process called "impedance matching") the driver to the acoustic network at points far away from the velocity nodes and simultaneously tune to mechanically resonate at the intended operating frequency. Mechanical resonance for the driver, as installed in the system, means that maintaining the reciprocating motion of the driver element requires no external forcing, except to overcome minor frictional or drag losses. The sum of the energies (kinetic and potential) is substantially constant, and any force applied to the driver is passed through to the load. Recently developed resonant linear motor/alternators, such as those disclosed in U.S. Pat. Nos. 5,146,123 and 5,389,844, are designed for exactly such operating conditions. Still, placement of an imperfect driver adjacent to the cooler heat exchanger can expose that site to the thermal loss heat from the driver, diminishing available refrigerating capacity.

Figure 9:
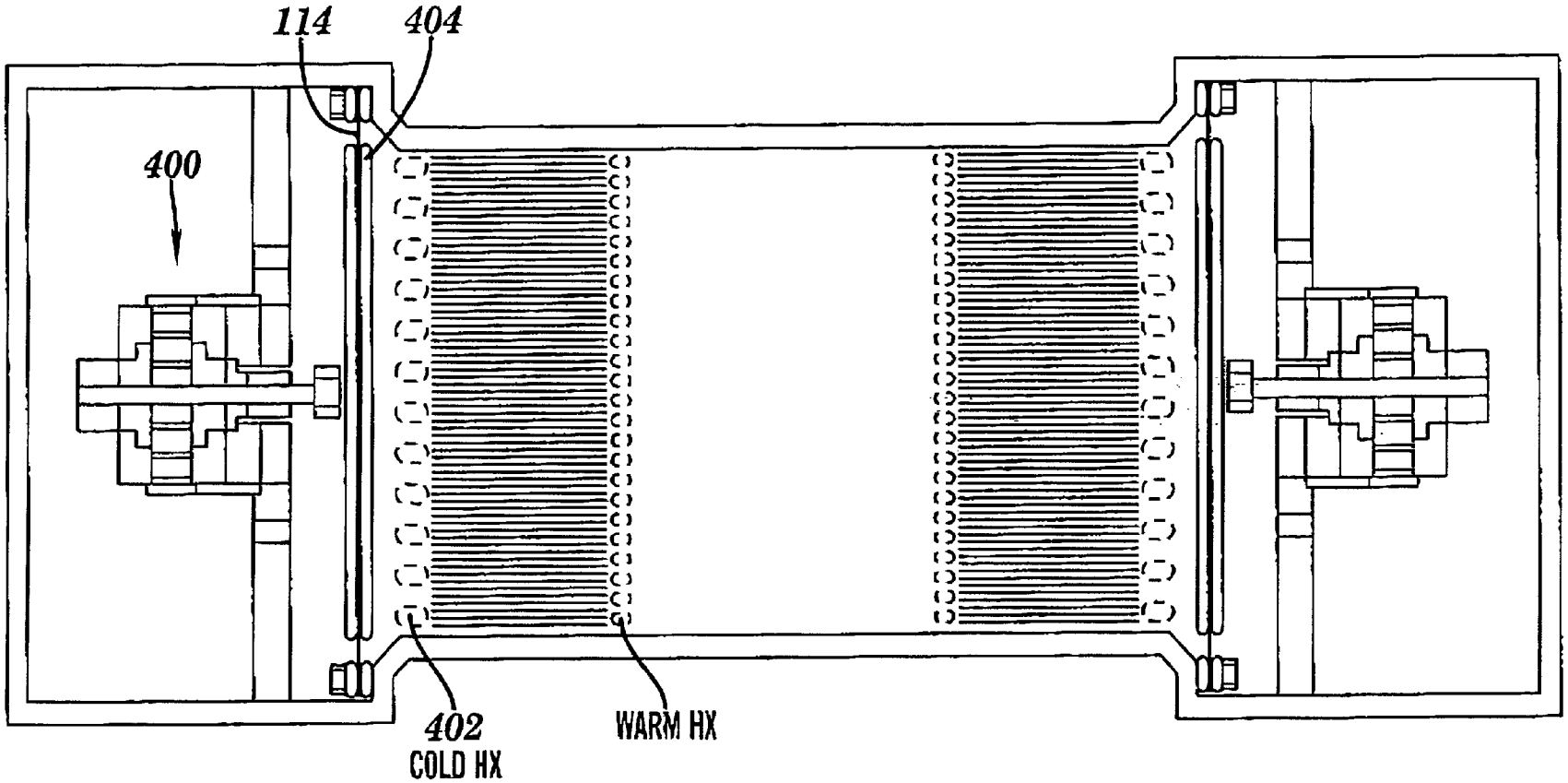
FIG. 9 shows double-ended thermoacoustic refrigerator incorporating a mechanical resonator in accordance with the present invention.

Referring to FIG. 9, in embodiments where a cooler heat exchanger 402 is at a temperature below the ambient, a thermal insulation 404 may be provided on member 114, e.g., the face. Note that FIG. 9 does not include a suspension element for clarity. Thermal insulation 404 minimizes the thermal contact between cooler heat exchanger 402 and the source of driver loss heat. This typically adds little size to the basic mechanical resonator. Note that the device of FIG. 9 includes two units joined together in a mirrored arrangement in a single housing to eliminate vibration.

It should be recognized that transducer 200, 300, 400 (FIG. 9) may be any mechanism for driving member 114 in a reciprocating motion. Transducer 200, 300, 400 may include, for example, a fixed structure with high magnetic permeability (e.g. iron), wrapped with at least one coil of electrically-conductive material (e.g., copper wire), and a moving element having at least one permanent magnet element with two opposite field vectors, positioned in a gap in the high-permeability fixed structure so that reciprocating movement of the magnets will bring each field region alternately into greater and lesser alignment with the permeable structure. Such a device is shown in FIG. 8. The transducer, if excited by oscillating force on its moving element, will produce alternating-current electric output, or if excited by alternating electric current, will produce an oscillating force on its moving element.

In terms of tuning, the moving element (i.e., output moving element) of the transducer and member 114 each have mass selectable within a range. The mass can be made to a selected value in any of a variety of ways, some of which may also affect stiffness by varying a facial area of member 114. The magnets and suspension elements provide stiffness against reciprocation away from a central, mean position in the allowable range of reciprocation. Additional discrete springs may be added or the suspension modified for more or less stiffness. In this way, the dynamic equivalence of this reciprocating motor/alternator to some portion of the gas resonator can be established. Collectively, the above processing for shortening a thermoacoustic device having a housing for containing a compressible fluid and thermodynamically active components therein that operate at a known frequency and a known temperature, can be stated as: determining dynamic conditions at a position within the housing; and replacing at least a portion of the housing to a side of the position by suspending a mechanical resonator having a fluid-blocking reciprocating member that matches the dynamic conditions at the position within the housing. The dynamic conditions may include, for example, a complex velocity and a pressure of the compressible fluid.

This mechanical resonator can be used especially for systems where a thermoacoustic or other resonant prime mover (e.g., acoustically-displaced Stirling or even a free-displacer Stirling engine) is combined in a single conversion system with a resonant thermoacoustic load (e.g., a pulse-tube or free-displacer Stirling refrigerator that converts thermal power to acoustic and back to thermal form, for heat pumping or refrigeration—see U.S. Pat. No. 4,858,441 to Wheatley et al. and U.S. Pat. No. 4,953,366 to Swift). In such combined and acoustically-coupled systems, the fluid resonator acts as a transmission only, though typically comprising about ⅔ of the length of the device. A mechanical resonator may be used instead between the driver and load, with dynamic conditions on both sides of the resonator matched to mimic the longer fluid resonator.

The primary transmission losses in a fluid resonator are associated with the high-velocity oscillating fluid motion in the central region. Use of the proposed mechanical resonator eliminates these losses, although clearance seals may require some losses instead. For clearances within the range of practical manufacture, clearance flow losses can be less than the viscous drag of the fluid resonator. Using a mechanical resonator with a transducer in the same class of device (i.e., thermal-acoustic-thermal) also allows the transducer to act as a starter for the system. It should be recognized that the teachings of the invention can be implemented in a number of ways. For example, FIG. 9 shows a section of a refrigerator built according to the teachings of the present invention. Note that this device is actually two units joined together in a mirrored arrangement in a single housing to eliminate vibration.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A mechanical resonator for a thermoacoustic device having a compressible fluid contained within a housing having a pair of heat exchangers and a thermodynamic medium therebetween, the resonator comprising:

a member for mimicking dynamic conditions at a position of the housing; and a linear suspension element suspending the member in the housing.

2. The resonator of claim 1, wherein the linear suspension element includes a plurality of legs each having a first portion for coupling to the member, and a second portion coupled to the housing.

3. The resonator of claim 1, including two linear suspension elements.

4. The resonator of claim 1, further comprising a transducer coupled to the member.

5. The resonator of claim 4, wherein the transducer is a linear motor.

6. The resonator of claim 1, wherein the mechanical resonator is positioned closer to a cooler one of the heat exchangers of the thermoacoustic device.

7. The resonator of claim 6, further comprising a thermal insulation coupled to the member.

8. The resonator of claim 1, wherein the housing has a length less than a solely acoustical housing operating at the same frequency.

9. A thermoacoustic system comprising:

a housing enclosing a compressible fluid capable of supporting an acoustical wave;

a first heat exchanger;

a second heat exchanger;

a thermodynamic medium interposed between the heat exchangers for sustaining a temperature gradient in the compressible fluid between the heat exchangers; and a mechanical resonator mounted in the housing adjacent the heat exchangers, the mechanical resonator including:

a member mounted for reciprocation along a direction of fluid oscillation and to form a substantial barrier to passage of the compressible fluid, and a linear suspension element for suspending the member during reciprocation, the suspension element coupled to the housing.

10. The system of claim 9, wherein the linear suspension element includes a plurality of legs each having a first portion for coupling to the member, and a second portion coupled to the housing.

11. The system of claim 9, including two linear suspension elements.

12. The system of claim 9, further comprising a transducer coupled to the member.

13. The system of claim 12, wherein the transducer is a linear motor.

14. The system of claim 9, wherein the system is operated as a standing wave system, and the mechanical resonator is positioned closer to a cooler one of the heat exchangers.

15. The system of claim 14, further comprising a thermal insulation coupled to the member.

16. The system of claim 9, wherein the housing has a length less than a solely acoustical housing operating at the same frequency.

17. A method for shortening a thermoacoustic device having a housing for containing a compressible fluid and thermodynamically active components therein that operate at a known frequency and a known temperature, the method comprising the steps of:

determining dynamic conditions at a position within the housing; and replacing at least a portion of the housing adjacent to the position by suspending a mechanical resonator having a member that matches the dynamic conditions at the position within the housing.

18. The method of claim 17, wherein the dynamic conditions include a complex velocity and a pressure of the compressible fluid.

19. The method of claim 17, wherein step of suspending includes providing a linear suspension having a plurality of legs each having a first portion for coupling to the member, and a second portion coupled to the housing.

20. A thermoacoustic system comprising:

a) a housing enclosing a compressible fluid capable of supporting an acoustical wave;

b) a standing wave thermoacoustic subsystem including:

a first heat exchanger, a second heat exchanger, wherein the second heat exchanger is cooler than the first heat exchanger, and a thermodynamic medium interposed between the heat exchangers for sustaining a temperature gradient in the compressible fluid between the heat exchangers;

c) a mechanical resonator mounted for reciprocation along a direction of fluid oscillation and to form a substantial barrier to passage of the compressible fluid; and d) a transducer coupled to the mechanical resonator.

21. The system of claim 20, further comprising a linear suspension element for suspending a member of the mechanical resonator during reciprocation, the suspension element coupled to the housing.

22. The system of claim 21, wherein the member includes a thermal insulation coupled thereto.

23. The system of claim 20, wherein the housing has a length less than a solely acoustical housing operating at the same frequency.

24. A mechanical resonator for a thermoacoustic device having a compressible fluid contained within a housing, the housing having a pair of heat exchangers and a thermodynamic medium therebetween, the resonator comprising:

a member adjacent a cooler one of the heat exchangers; and a thermal insulation on the member.

25. The mechanical resonator of claim 24, further comprising a linear suspension for mounting the member within a housing of the thermoacoustic device.

26. The mechanical resonator of claim 24, wherein the thermoacoustic device includes a standing wave thermoacoustic subsystem.

* * * * *

UNITED STATES PATENT AND TRADEMARK OFFICE

CERTIFICATE OF CORRECTION

PATENT NO. : 6,578,364 B2
DATED : June 17, 2003
INVENTOR(S) : John A. Corey

It is certified that error appears in the above-identified patent and that said Letters Patent is hereby corrected as shown below:

Column 1,
Line 15, delete “modem” and insert -- modern --.

Signed and Sealed this

Seventh Day of October, 2003

JAMES E. ROGAN
*Director of the United States Patent and Trademark Office*